US009121138B2

(12) United States Patent
Nosker et al.

(10) Patent No.: US 9,121,138 B2
(45) Date of Patent: Sep. 1, 2015

(54) POLYMER BASED RAILROAD TIE SHAPED TO REDUCE CENTER BOUNDING

(75) Inventors: Thomas Nosker, Stockton, NJ (US); Jennifer Lynch, Franklin Park, NJ (US)

(73) Assignee: RUTGERS, THE STATE UNIVERSITY OF NEW JERSEY, New Brunswick, NJ (US)

( * ) Notice: Subject to any disclaimer, the term of this patent is extended or adjusted under 35 U.S.C. 154(b) by 0 days.

(21) Appl. No.: 13/578,855

(22) PCT Filed: Feb. 17, 2011

(86) PCT No.: PCT/US2011/025237

§ 371 (c)(1), (2), (4) Date: Sep. 14, 2012

(87) PCT Pub. No.: WO2011/103284

PCT Pub. Date: Aug. 25, 2011

(65) Prior Publication Data

US 2013/0008973 A1 Jan. 10, 2013

Related U.S. Application Data

(60) Provisional application No. 61/305,386, filed on Feb. 17, 2010.

(51) Int. Cl.
*E01B 3/00* (2006.01)
*E01B 3/44* (2006.01)

(52) U.S. Cl.
CPC .... *E01B 3/44* (2013.01); *E01B 3/00* (2013.01)

(58) Field of Classification Search
CPC ..... E01B 3/00; E01B 3/10; E01B 3/18; E01B 3/36; E01B 3/44; E01B 3/46
USPC ..... 238/30, 29, 35, 54, 83, 94, 95, 86
See application file for complete search history.

(56) References Cited

U.S. PATENT DOCUMENTS

| | | | | |
|---|---|---|---|---|
| 1,365,550 | A * | 1/1921 | Schmitt | 238/30 |
| 5,609,295 | A * | 3/1997 | Richards | 238/84 |
| 6,021,958 | A * | 2/2000 | Smith | 238/83 |
| 6,179,215 | B1 * | 1/2001 | Shea | 238/29 |
| 6,247,651 | B1 * | 6/2001 | Marinelli | 238/84 |
| 7,314,182 | B2 * | 1/2008 | Little et al. | 238/101 |
| 8,342,420 | B2 * | 1/2013 | Roberts, Jr. | 238/84 |
| 8,366,015 | B2 * | 2/2013 | Van Belkom | 238/83 |
| 2005/0156055 | A1 * | 7/2005 | Kenney et al. | 238/84 |
| 2007/0187522 | A1 * | 8/2007 | Kirchmer et al. | 238/84 |
| 2012/0104110 | A1 * | 5/2012 | Roberts, Jr. | 238/84 |
| 2012/0286056 | A1 * | 11/2012 | Qi et al. | 238/85 |
| 2013/0008973 | A1 * | 1/2013 | Nosker et al. | 238/35 |

* cited by examiner

*Primary Examiner* — Jason C Smith
(74) *Attorney, Agent, or Firm* — Fox Rothschild LLP

(57) ABSTRACT

A railroad tie composed of an immiscible polymer blend having a portion of the underside curved orthogonal to the longitudinal axis of the tie or curved both orthogonal and parallel to the longitudinal axis of the tie, forming a saddle shape, for purposes of reducing the center bounding problems encountered in prior art synthetic railroad ties.

14 Claims, 1 Drawing Sheet

POLYMER BASED RAILROAD TIE SHAPED TO REDUCE CENTER BOUNDING

RELATED APPLICATIONS

This application is the U.S. National Phase of International Patent Application Serial No. PCT/US11/25237, filed Feb. 17, 2011 which claims priority under 35 U.S.C. §119(e) to U.S. Provisional Patent Application Ser. No. 61/305,386, filed Feb. 17, 2010, both of which are hereby incorporated by reference in their entireties.

FIELD OF THE INVENTION

The present invention relates to manufactured railroad ties, and in particular, to railroad ties composed of a composite material which are shaped to reduce center bounding.

BACKGROUND OF THE INVENTION

Typical railroad ties manufactured from wood require frequent replacement due to exposure to the environment, including weather, insects and micro-organisms, all of which can shorten the life of a wooden tie. Wooden ties may also be chemically treated to lengthen their life, but such treatment may raise environmental concerns, and adds to the cost of manufacturing the tie. It is known to manufacture ties from a plastic or composite material, which alleviates the problems associated with wooden ties, but which also causes problems not associated with wooden ties.

Ties made of wood tend to settle into the ballast, typically rocks, over a period of time and repeated loadings, and, because the properties of wood orthogonal to the long axis of the tree and tie are much weaker than the properties along the axis, the ties become naturally dimpled on the bottom as they settle into the ballast. This dimpling, and the related mechanical interaction between the wooden ties and the ballast tend help to keep the tie anchored in place.

In the U.S., a typical railroad tie is rectangular in shape, having a cross section 7 inches in height by 9 inches in width. Railroad ties manufactured from plastics or composites are typically the same size and shape as ties made of wood, and must meet the same structural specification as wooden ties. Specifically, the tie must not allow an increase in the gauge of the tracks by more than 0.125 inches under a lateral load of 24,000 lbs. and a static vertical load of 39,000 lbs. In addition, the tie must be able to withstand a dynamic vertical load of 140,000 lbs.

The mechanical properties of plastic and composite ties may prevent these ties from becoming dimpled and indented with ballast over time as occurs with wooden ties. To overcome this, ties manufactured from plastics or composites sometimes have a pattern embossed or imprinted on the bottoms and sides to allow increased mechanical interaction with the ballast, such as to emulate the effect which occurs naturally with wooden ties.

Unfortunately, these plastic and composite ties have demonstrated that a tendency to become "center bound", which makes them prone to cracking in the middle of the tie. A center bound tie is one that is supported underneath with a higher mound of ballast in the center of the tie than exists at the ends of the tie or under the rails. This causes the ties to flex along the longitudinal axis and, to a somewhat lesser extent, along the axis orthogonal to the longitudinal axis, every time that the tie is loaded by a train moving over the track. This eventually causes the tie to crack, and as a result, the tie is unable to hold gauge with the rails. Therefore, it would be advantageous to have a tie composed of a plastic or composite material which is shaped to alleviate the center bounding problem.

SUMMARY OF THE INVENTION

The present invention provides a railroad tie formed of a composite material which are shaped to reduce center bounding. In a preferred embodiment, the railroad tie comprises a rectangular-shaped block of a composite-material, flat areas defined on either end of the underside of the tie, a middle portion, defined on the underside of the tie between said flat areas, said middle portion having a first curvature orthogonal to the longitudinal axis of the tie, said curvature having a radius which varies along the longitudinal axis of the tie, said radius having a minimum in the center of said tie tapering to infinity where said middle portion meets said flat areas.

DETAILED DESCRIPTION OF THE INVENTION

One solution to the center bounding problem, in accordance with the present invention, is to mold the tie with flat bottoms under the tie plates and at the ends of the tie, but to mold a saddle shape in the bottom in the tie between the areas of the tie plates. A saddle shape will have two radii of curvature, one along the longitudinal axis of the tie and the other orthogonal to the longitudinal axis of the tie.

Figure 1:
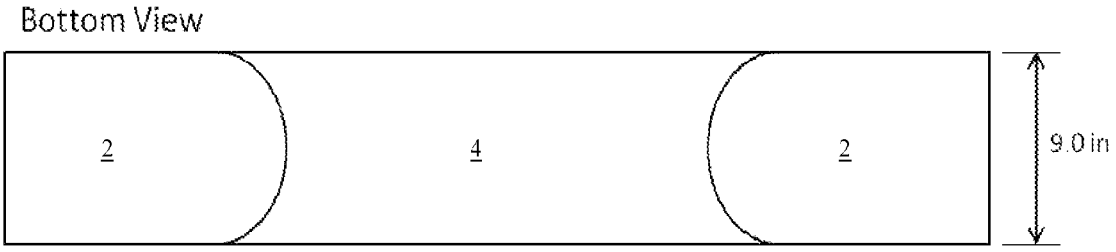
FIG. 1 show a bottom view of a railroad tie manufactured in accordance with this invention
Figure 2:
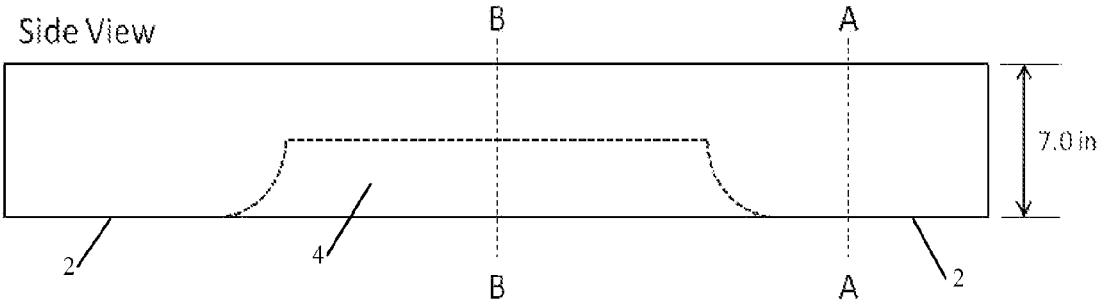
FIG. 2 shows a side view of the railroad tie of FIG. 1

In the U.S., the typical gauge used in railroads is 56.5 inches. It is desirable that the both the top and bottom surfaces of the tie be flat in the area where the tie plates sit, such as to not interfere with the spiking area of the tie and to allow for flat, load bearing bottoms, 2, from the tie area out to the end of the tie. This area could be as much as 3 inches from the inside edge of each rail, leaving a maximum distance of about 50.5 inches on the bottom of the tie in which to form a curvature parallel to the longitudinal axis of the tie. This area is shown as reference number 4 in FIG. 1.

Such as to not compromise the structural integrity of the tie, it is also desirable that the thickness of the tie, which is typically 7 inches in height, not be reduced by more than 1 inch by the curvature parallel to the longitudinal axis of the tie. Over a maximum distance of 50.5 inches, a radius of curvature parallel to the longitudinal axis of the tie of 637 inches results in a reduction of thickness of the tie of 1 inch. If the radius of curvature is increased to 2,500 inches, the reduction of thickness in the middle of the tie is reduced to ¼ inch. Therefore, the radius of curvature parallel to the longitudinal axis of the tie should not be less than 637 inches.

In a second embodiment of the invention, there may be no real need to create any curvature along the tie length, as the intention of the saddle is to force rocks out from under the middle of the tie via the shortest path. Because the shortest path is along a direction orthogonal to the longitudinal axis of the tie, the curvature in this direction is more critical than the curvature along the longitudinal axis, and, as a result, in alternate embodiments of the invention, there may be no curvature along the longitudinal axis of the tie. Note that a radius of curvature of infinity results in a flat surface parallel to the longitudinal axis of the tie. Therefore, the radius of curvature along the tie length should be between 637 inches and infinity.

Figure 3:
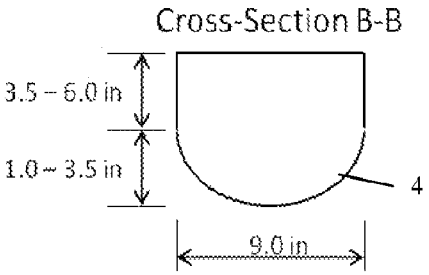
FIG. 3 shows cross section B-B of the railroad tie of FIG. 2.
Figure 4:
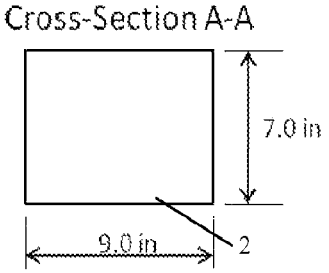
FIG. 4 shows cross section A-A of the railroad tie of FIG. 2.

The curvature orthogonal to the longitudinal axis of the tie is thus more critical. This curvature may vary along the longitudinal axis of the tie from a maximum in the center of the tie, shown cross-sectionally in FIG. 3, to zero (no curvature) in the area of the tie outside of the 50.5 inch center portion, shown cross-sectionally in FIG. 4. Thus, the radius of curvature orthogonal to the longitudinal axis of the tie will also vary along the length of the tie, having a minimum of about 4.5 inches in the center of the tie to maintain the maximum reduction in the thickness of the tie of 1 inch. Preferably, this radius of curvature is tapered from the minimum at the center of the tie to infinity along the length of the tie outside the 50.5 inch middle portion, to eliminate sharp edges, which could create points of structural weakness in the tie The minimum radius of curvature in the center of the tie could be increased to a range of between 9 inches and 18 inches, but this may result in making it less effective in forcing the ballast to the sides of the tie. Therefore, in preferred embodiments of the invention, this critical curvature should be between 4.5 inches and 14 inches.

The saddle-shaped area formed on the underside of the tie will serve to apply some component of force on the ballast that might collect under the middle of the tie to push the ballast out of the way and let the tie settle with flat support beneath the tie plates. An additional benefit to this is that the single tie push test number is likely to increase as the tie settles.

In an alternate embodiment, the saddle-shaped area may be formed with dimples therein for increased mechanical interaction with the ballast, as disclosed in U.S. Pat. No. 7,011,253, entitled "Engineered Railroad Ties," which is incorporated herein by reference.

Typical prior art ties are composed of a composite of HDPE (high-density polyethylene) and fiber glass, mica, talc or other similar materials well known in the art, and those composites are suitable for forming the ties disclosed herein as well.

Preferably, however, the ties are composed of an immiscible polymer blend comprising (1) polyethylene (PE) and (2) acrylonitrile-butadiene-styrene (ABS), polycarbonate (PC), or a mixture of ABS and PC. In the preferred embodiment, the PE is high density PE (HDPE). Immiscible polymer blends composed of PE in combination with PC and/or ABS or a mixture thereof tends to increase the stiffness of an article manufactured with the blend. In the case of railroad ties, for example, the modulus E of the composition should be at least about 170,000 and have a strength of at least 2500 psi. For example, a blend containing about 10% ABS and about 90% HDPE would have a modulus of about 175,000.

In addition, reinforcing fillers may be used to further improve the properties of the immiscible polymer blend such as the tensile strength, impact strength, stiffness and heat distortion. Examples of fillers include fiberglass, asbestos, wollastonite, whiskers, carbon filaments, talc, clays, mica, calcium carbonate, fly ash and ceramics. Preferably filamentous fillers such as glass fibers will be used because they tend to improve stiffness without significantly reducing impact properties or increasing density.

The invention has been described in terms of measurements based upon gauges of railways used in the United States. However, the invention is also applicable to areas of the world where other size gauges and differing sizes of railway ties are used. As has been discussed herein, it is desirable that, for a tie having a height of 7 inches, the overall height of the railway tie should not be reduced by more than 1 inch. This translates to a maximum reduction in size of about 15% of the overall height of the tie. Therefore, if ties of varying heights are being produced, this general guideline should be used.

Note that the railroad tie of the present invention has been described in terms of a particular size for use in the U.S., however, this description is only exemplary in nature and is not meant to limit the invention in any way. The scope of the invention is defined by the following claims.

We claim:

1. A railroad tie formed of a composite material, comprising:

a rectangular-shaped block of said composite-material;

flat areas defined on either end of the underside of the tie;

a middle portion, defined on the underside of the tie between said flat areas, said middle portion having a first curvature orthogonal to the longitudinal axis of the tie, said curvature having a radius which varies along the longitudinal axis of the tie, said radius having a minimum in the center of said tie tapering to infinity where said middle portion meets said flat areas, and said curvature having a convex exterior surface.

2. The railroad tie of claim 1 wherein tie has a height of 7 inches, and a width of 9 inches, and wherein said middle portion has a maximum length of 50.5 inches and further wherein said minimum radius of said first curvature is in the range of 4.5 inches to 14 inches.

3. The railroad tie of claim 2 wherein said middle portion has a second curvature formed parallel to the longitudinal axis of said tie.

4. The railroad tie of claim 2 wherein said minimum radius of said first curvature is 4.5 inches.

5. The railroad tie of claim 1 wherein said middle portion has a second curvature formed parallel to the longitudinal axis of said tie.

6. The railroad tie of claim 5 wherein the variable second curvature extends the entire length of said middle portion.

7. The railroad tie of claim 5 wherein said first curvature and said second curvature form a saddle shape.

8. The railroad tie of claim 5 wherein said second curvature has a radius which reduces the height of the center of said middle portion by a maximum of 15%.

9. The railroad tie of claim 5 wherein said variable second curvature has a radius which reduces the height of the center of said middle portion by a maximum of 1 inch.

10. The railroad tie of claim 6 wherein said radius of said second curvature is a minimum of 637 inches.

11. The railroad tie of claim 1 wherein said composite material is high density polyethylene having a filler.

12. The railroad tie of claim 11 wherein said immiscible polymer blend further comprises a filler.

13. The railroad tie of claim 1 wherein said composite material is an immiscible polymer blend comprising:

high density polyethylene; and acrylonitrile-butadiene-styrene, polycarbonate or a mixture of acrylonitrile-butadiene-styrene and polycarbonate.

14. The railroad tie of claim 1 wherein there is no curvature along the longitudinal axis of the tie.

* * * * *